US010240863B2

(12) United States Patent
Tremblay et al.

(10) Patent No.: US 10,240,863 B2
(45) Date of Patent: Mar. 26, 2019

(54) METHOD AND ARRANGEMENT FOR PRODUCING LIQUEFIED METHANE GAS (LMG) FROM VARIOUS GAS SOURCES

(71) Applicant: RTJ TECHNOLOGIES INC., Montreal (CA)

(72) Inventors: Charles Tremblay, Montreal (CA); Alain Roy, Montreal (CA); Simon Jasmin, Montreal (CA)

(73) Assignee: RTJ TECHNOLOGIES INC., Montreal, Quebec (CA)

( * ) Notice: Subject to any disclaimer, the term of this patent is extended or adjusted under 35 U.S.C. 154(b) by 145 days.

(21) Appl. No.: 15/388,987

(22) Filed: Dec. 22, 2016

(65) Prior Publication Data

US 2017/0102182 A1 Apr. 13, 2017

Related U.S. Application Data

(63) Continuation of application No. PCT/CA2015/050595, filed on Jun. 25, 2015.

(30) Foreign Application Priority Data

Jun. 27, 2014 (CA) ..... 2855383

(51) Int. Cl.
*F25J 3/02* (2006.01)
*C10L 3/10* (2006.01)

(52) U.S. Cl.
CPC ..... *F25J 3/0209* (2013.01); *F25J 3/0233* (2013.01); *F25J 3/0257* (2013.01); *C10L 3/102* (2013.01);
(Continued)

(58) Field of Classification Search
CPC ..... F25J 3/0209; F25J 3/0233; F25J 3/0257; F25J 2200/02; F25J 2200/72;
(Continued)

(56) References Cited

U.S. PATENT DOCUMENTS 2,823,523 A 2/1958 Eakin et al.
3,596,472 A * 8/1971 Streich ..... F25J 1/0022 62/623

(Continued)

FOREIGN PATENT DOCUMENTS

CA 2903679 C 8/2016
CN 103353207 A 10/2013
WO 2015196295 A1 12/2015

OTHER PUBLICATIONS

Ruhemann M: "Cryogenic Techniques in Enhanced Recovery of Oil and Gas", Indian Journal of Cryogen, Indian Cryogenics Council, Calcutta, India, vol. 9, No. 4, Jan. 1, 1984, pp. 256-261, XP008007141, ISSN: 0379-0479.

(Continued)

*Primary Examiner* — Brian M King
(74) *Attorney, Agent, or Firm* — IPAXIO S.E.N.C.

(57) ABSTRACT

The method is carried out for continuously producing a liquefied methane gas (LMG) from a pressurized mixed methane gas feed stream. It is particularly well adapted for use in relatively small LMG distributed production plant, for instance those ranging from 400 to 15,000 MT per year, and/or when the mixed methane gas feed stream has a wide range of nitrogen-content proportions, including nitrogen being substantially absent. The proposed concept can also be very useful in the design of medium-scale and/or large-size plants, including ones where the nitrogen content always remains above a certain threshold. The methods and arrangements proposed herein can mitigate losses of methane gas when venting nitrogen, for instance in the atmosphere.

20 Claims, 5 Drawing Sheets

(52) U.S. Cl.
CPC ..... *C10L 3/106* (2013.01); *F25J 2200/02* (2013.01); *F25J 2200/72* (2013.01); *F25J 2200/74* (2013.01); *F25J 2205/04* (2013.01); *F25J 2205/50* (2013.01); *F25J 2210/02* (2013.01); *F25J 2210/04* (2013.01); *F25J 2210/42* (2013.01); *F25J 2210/66* (2013.01); *F25J 2215/04* (2013.01); *F25J 2215/60* (2013.01); *F25J 2220/02* (2013.01); *F25J 2220/60* (2013.01); *F25J 2220/66* (2013.01); *F25J 2220/68* (2013.01); *F25J 2230/30* (2013.01); *F25J 2230/60* (2013.01); *F25J 2240/44* (2013.01); *F25J 2270/18* (2013.01); *F25J 2270/66* (2013.01); *F25J 2290/12* (2013.01); *F25J 2290/34* (2013.01); *F25J 2290/62* (2013.01)

(58) Field of Classification Search
CPC .. F25J 2200/74; F25J 2205/04; F25J 2205/50; F25J 2210/02; F25J 2210/04; F25J 2210/42; F25J 2210/66; F25J 2215/04; F25J 2215/60; F25J 2220/02; F25J 2220/60; F25J 2220/68; F25J 2230/30; F25J 2230/60
See application file for complete search history.

(56) References Cited

U.S. PATENT DOCUMENTS

| | | | | |
|---|---|---|---|---|
| 3,874,184 | A | 4/1975 | Harper et al. | |
| 4,230,469 | A | 10/1980 | Grimm et al. | |
| 4,238,211 | A | 12/1980 | Stuart | |
| 4,411,677 | A | 10/1983 | Pervier et al. | |
| 4,415,345 | A | 11/1983 | Swallow | |
| 4,496,382 | A * | 1/1985 | Geist | F25J 3/0209 62/623 |
| 4,501,600 | A | 2/1985 | Pahade | |
| 4,504,295 | A | 3/1985 | Davis et al. | |
| 4,662,919 | A | 5/1987 | Davis | |
| 4,681,612 | A | 7/1987 | O'Brien et al. | |
| 4,987,744 | A | 1/1991 | Handley et al. | |
| 5,535,594 | A | 7/1996 | Grenier | |
| 5,642,630 | A | 7/1997 | Abdelmalek et al. | |
| 6,199,403 | B1 | 3/2001 | Cole et al. | |
| 6,223,557 | B1 | 5/2001 | Cole | |
| 6,631,626 | B1 | 10/2003 | Hahn | |
| 6,751,984 | B2 | 6/2004 | Neeraas et al. | |
| 6,978,638 | B2 | 12/2005 | Brostow et al. | |
| 7,520,143 | B2 | 4/2009 | Spilsbury | |
| 8,381,544 | B2 | 2/2013 | Coyle | |
| 9,023,131 | B2 | 5/2015 | Tremblay et al. | |
| 2006/0248921 | A1 | 11/2006 | Hosford et al. | |
| 2007/0095099 | A1 | 5/2007 | Paradowski | |
| 2010/0000234 | A1 * | 1/2010 | Bras | F25J 3/0209 62/50.5 |
| 2010/0058802 | A1 | 3/2010 | Brendeng et al. | |
| 2012/0060554 | A1 | 3/2012 | Schmidt | |
| 2012/0067079 | A1 | 3/2012 | Sethna et al. | |
| 2015/0285553 | A1 | 10/2015 | Oelfke et al. | |
| 2017/0074583 | A1 | 3/2017 | Tremblay et al. | |

OTHER PUBLICATIONS

Extended European Search Report in EP15812354.7 (EP3161113) dated Jun. 16, 2017.
Machine translation in English of CN103353207A.
PCT International Search Report and Written Opinion in PCT/CA2015/050595 by the Canadian Intellectual Property Office dated Sep. 1, 2015.

* cited by examiner

METHOD AND ARRANGEMENT FOR PRODUCING LIQUEFIED METHANE GAS (LMG) FROM VARIOUS GAS SOURCES

CROSS-REFERENCE TO PRIOR APPLICATIONS

The present case is a continuation of PCT Application No. PCT/CA2015/050595 filed on 25 Jun. 2015. PCT/CA2015/050595 claims the benefits of Canadian patent application No. 2,855,383 filed on 27 Jun. 2014. The entire contents of these prior patent applications are hereby incorporated by reference.

TECHNICAL FIELD

The technical field relates generally to methods and arrangements for producing Liquefied Methane Gas (LMG) using one or more gas sources.

BACKGROUND

Natural gas is a hydrocarbon gas mixture consisting primarily of methane gas ($CH_4$) and is generally used as a source of energy. Natural gas can be compressed and transported in gas pipelines but it can also be converted from its primary gas form to a liquid form at cryogenic temperatures for ease of storage and transportation. Liquefied natural gas (LNG) takes considerably less volume than natural gas in a gaseous state. This makes LNG cost efficient to transport over long distances where pipelines do not exist.

Various technologies exist for the production of LNG, especially ones that can be used in industrial base load production plants and in peak shaving plants. These plants generally have large LNG production capacities but they require a substantial upfront investment. For instance, base load production plants often have a LNG production capacity ranging from about 1,500,000 to 5,000,000 MT per year. These plants are generally used to produce large amounts of LNG that will be stored in cryogenic tanks prior to transfer to LNG transport sea vessels or tankers. They are often supplied directly with natural gas from gas wells or from pipelines. Peak shaving plants have LNG production capacities that are often ranging from about 35,000 to 150,000 MT per year. These plants are used for storing natural gas in liquid form to meet the demand of natural gas pipeline during peak consumption periods. They are generally supplied in natural gas of pipeline quality.

Natural gas includes mostly methane in high concentrations, such as about 85% vol. for instance, with the balance of the gas stream including gases such as ethane, propane, higher hydrocarbon components, a small proportion of water vapor, nitrogen and/or carbon dioxide. Other components such as mercury, hydrogen sulfide and mercaptan can also be present in lower concentrations. Variants are possible.

LNG is increasingly used as an alternative fuel for transportation since it offers many advantages over other available kinds of fuel. For instance, it is an alternative fuel cleaner than other fossil fuels, with lower emissions of carbon and lower particulate emissions per equivalent distance traveled. LNG is also generally more efficient and provides a significant increase in the useful life of the engines. However, despite all its advantages, the widespread use of LNG in transportation faces several limitations due in most part to a lack of availability. There is a limited number of LNG production plants and a corresponding limited number of distribution points, i.e. fueling stations, particularly outside densely populated areas. Still, transporting LNG over long distances in relatively small quantities to supply remote fueling stations lowers environmental and economic benefits of LNG.

Small LNG production facilities, often called mini LNG plants, have been suggested in the past. They have LNG production capacities often ranging from about 3,500 to 35,000 MT per year. Mini LNG plants are also generally supplied in natural gas of pipeline quality. They require somewhat lower capital investment costs than base load or peak shaving plants but these costs can still be relatively large compared to their LNG production capacities. They are also less energy efficient than common larger plants. For instance, there is generally a significant loss of natural gas in the order of about 20 to 35% vol. of the initial methane gas input in mini LNG plants. This results in economical losses and releasing such large quantities of methane gas directly into the atmosphere reduces the environmental benefits of LNG in transportation.

Natural gas is only one among a number of different possible sources of methane gas. For instance, landfill sites and anaerobic digesters can generate significant amounts of biogas which contains methane gas, generally in concentration ranging from about 40 to 65% vol. under favorable operating conditions. Other gases that are often present in biogas include carbon dioxide in concentration that can generally reach about 50% vol. of the gas stream, nitrogen in concentration generally varying from a few percent to about 30% vol. of the gas stream, and possibly in smaller concentrations, oxygen in concentration that can generally reach about 3% vol. of the gas stream, and hydrogen sulfide in concentration that can generally reach about 0.5% vol. of the gas stream. These values are only typical examples. Other components can be present in even smaller concentrations, such as siloxanes, mercury, volatile organic carbons (VOC) and mercaptan.

Biogas originating from a landfill site is generally saturated in water at the pressure and temperature conditions occurring at the capture points. Also, it can sometimes have lower methane gas concentrations than the usual amounts due to presence of air infiltrations. If air is introduced directly from external headers, then the concentration of oxygen and nitrogen will substantially remain the same and air will only dilute the biogas generated in the landfill site. However, when air is introduced into the landfill site itself before entering the biogas headers, some or all of the oxygen can be transformed into carbon dioxide while the nitrogen will not be affected.

The methane gas fraction contained in biogas can be transformed into Liquefied Methane Gas (LMG). LMG can provide an equivalent to LNG in terms of quality and energy content. Thus, one could use LMG instead of LNG at fueling stations. This is particularly useful since biogas can be obtained locally, particularly from municipal landfill sites. Transforming biogas into LMG from small distributed production plants would then be highly desirable since this will promote an increase in the number of fueling stations, particularly in remote areas. It can also offer significant environmental and economic benefits over burning biogas in gas flares and/or releasing unburned biogas directly into the atmosphere.

Landfill sites and anaerobic digesters often have a methane production capacity ranging from about 400 to 15,000 MT per year. They are thus smaller in capacity than typical mini LNG plants and the return on investment as well as the profitability of the whole operation may be difficult to obtain using existing approaches. Most liquefaction plants are designed for use in dedicated arrangements that are substantially stable and specific to a given site. Adapting existing designs for use in a wide variety of conditions is not easy to achieve. There are also numerous challenges associated specifically with the transformation of the methane gas fraction contained in biogas into LMG that are unique to biogas. One of these challenges is the unpredictability of the biogas in terms of the flow rate and the proportion of the methane gas fraction, particularly when biogas is captured in a landfill site. The flow rate of biogas collected from a landfill site may sometimes be insufficient to transform it into LMG and/or it may have a methane gas fraction that is insufficient to produce the desired quantity of LMG due to air infiltrations.

Another of the challenges associated with the transformation of the methane gas fraction contained in biogas into LMG is the economics of the whole operation. High capital-investment costs may deter commercial ventures from building a small plant. In particular, the costs cannot be compensated by large volumes of sales. High operational costs of the equipment required to carry out the LMG production will also play an important role. Even when a plant uses its own methane gas it produces for fulfilling its energy requirements, the LMG output will be lower. Yet, losses of methane gas due to limitations in the processes will also have an impact on the profitability of the operation.

A large part of the relatively high capital-investment and operational costs of existing systems are related to the very high pressures involved. Pressures in the order of about 6,800 kPag (1,000 psig), or even more, are not uncommon. They are useful for producing the extremely cold temperatures, i.e. cryogenic temperatures, required for condensing and storing the methane in a liquefied form at about −160° C. However, the acquisition costs of high-pressure compressors and other associated equipment required to build the corresponding plant infrastructure can quickly become a predominant factor, particularly in smaller plants. The energy requirements for operating these high-pressure compressors are also very high.

LNG and natural gas of pipeline quality have both a low nitrogen concentration. Nevertheless, nitrogen can be present in natural gas prior to liquefaction, even after the various gas treatments carried out. For instance, nitrogen is sometimes mixed with natural gas as part of the natural gas extraction process from a gas well. Most of this nitrogen must be removed afterwards, for instance in a distillation column. Cryogenic temperatures are thus useful for separating nitrogen from methane when the concentration of nitrogen is not negligible, for instance about 3% or above.

Nitrogen is generally not considered to be a very good refrigerant but when compressed and then expanded with a very high pressure drop, it can yield very low temperatures and be used as a cryogenic refrigerant to liquefy methane. One approach is to use nitrogen already mixed with the natural gas as a refrigerant to both liquefy the methane gas and separate nitrogen therefrom. U.S. Pat. No. 6,978,638 (Brostow et al.) of 2005 discloses an example of such approach. However, high capital-investment costs, high operational costs and the complexity of such equipment are very limiting factors. Another limitation is that the presence of nitrogen is always needed and the process stops working if the proportion of nitrogen in the gas feed stream becomes too low.

Other existing approaches generally suffer from similar limitations and can be difficult to implement for a number of reasons, particularly in relatively small plants.

Overall, existing approaches are often:

- difficult to achieve on relative small implementations, for instance LMG production capacities ranging from about 400 to 15,000 MT per year to match the methane-gas throughput of landfill sites and anaerobic digesters;
- not capable of being carried out continuously over extended period of time when the proportion of nitrogen in the incoming gas feed stream falls down to a relatively low concentration;
- costly in terms of the upfront investment and energy requirements;
- difficult to implement in a wide variety of contexts in order to produce LMG of constant quality regardless of the source of the methane gas being used; and/or
- not well adapted for the design of generic plants, such as plants that can be preassembled in a factory and delivered to various kinds of sites as prepackaged units that are ready for operation in a relatively short amount of time.

Accordingly, there is still room for many improvements in this area of technology.

SUMMARY

The proposed concept can simultaneously address at least many of the challenges and limitations of existing approaches. It provides a way to produce LMG at much lower pressures than existing arrangements and can process a mixed methane gas feed stream having a wide range of nitrogen-content proportions, including a total absence or near total absence of nitrogen. It is particularly well adapted for use in relatively small LMG production plants, for instance those having capacities ranging from about 400 to 15,000 MT per year, since the upfront investment costs and energy requirements are relatively low. It can be used for producing LMG having a constant quality regardless of the source of the methane gas being used, which is desirable when using biogas. The proposed concept can also be very useful in the design of medium-scale or even large-size plants, including ones where the nitrogen-gas content always remains above a certain threshold. The methods and arrangements proposed herein can mitigate losses of methane gas when venting nitrogen, for instance into the atmosphere. The design of the generic plants that can be preassembled in a factory and delivered to various kinds of sites as prepackaged units that are ready for operation in a relatively short amount of time is now greatly facilitated.

In one aspect, there is provided a method of continuously producing a liquefied methane gas (LMG) from a pressurized mixed methane gas feed stream, the mixed methane gas feed stream containing methane and a variable concentration of nitrogen within a range that includes nitrogen being substantially absent from the mixed methane gas feed stream, the method including the simultaneous steps of: (A) passing the mixed methane gas feed stream through a first heat exchanger and then through a second heat exchanger to condense at least a portion of the mixed methane gas feed stream, the first heat exchanger using a first cryogenic refrigerant and the second heat exchanger using a second cryogenic refrigerant; (B) sending the mixed methane gas feed stream coming out of the second heat exchanger though a mid-level inlet of a fractional distillation column; (C) when nitrogen is present in the mixed methane gas feed stream, separating the mixed methane gas feed stream inside the fractional distillation column into a methane-rich liquid fraction and a nitrogen-rich gas fraction; (D) withdrawing the methane-rich liquid fraction accumulating at a bottom of the fractional distillation column through a bottom outlet, the methane-rich liquid fraction constituting the LMG; (E) passing the LMG from the bottom outlet in step (D) through a third heat exchanger, the third heat exchanger using the second cryogenic refrigerant to further cool the LMG; (F) when nitrogen is present in the mixed methane gas feed stream in step (C): (i) withdrawing the nitrogen-rich gas fraction at a top of the fractional distillation column through a top outlet; (ii) passing the nitrogen-rich gas fraction through a fourth heat exchanger and then through a fifth heat exchanger, the fourth heat exchanger using the first cryogenic refrigerant and the fifth heat exchanger using the second cryogenic refrigerant; (iii) introducing the nitrogen-rich gas fraction coming out of the fifth heat exchanger into a nitrogen phase separator vessel where a liquid phase is separated from a gas phase; (iv) withdrawing the liquid phase accumulating inside the nitrogen phase separator vessel and introducing the withdrawn liquid phase by gravity into the fractional distillation column as a reflux stream through an overhead inlet of the fractional distillation column, the overhead inlet being located vertically above the mid-level inlet and below the top outlet; (v) withdrawing the gas phase from inside the nitrogen phase separator vessel and passing the withdrawn gas phase directly into an expansion valve; (vi) using the expanded gas coming out of the expansion valve as the first cryogenic refrigerant, the first cryogenic refrigerant circulating in an open-loop first refrigerant circuit originating at an outlet of the expansion valve and then passing through, in succession, the fourth heat exchanger and the first heat exchanger; and (vii) venting the first cryogenic refrigerant, coming from the first heat exchanger, out of the first refrigerant circuit; and (G) circulating the second cryogenic refrigerant in a closed-loop second refrigerant circuit, the second refrigerant circuit extending from an independent cryogenic refrigeration system to the fifth heat exchanger, from the fifth heat exchanger to the third heat exchanger, from the third heat exchanger to the second heat exchanger, and then from the second heat exchanger back to the independent cryogenic refrigeration system.

In another aspect, there is provided a method of continuously producing a liquefied methane gas (LMG) from a pressurized mixed methane gas feed stream, the mixed methane gas feed stream containing methane and a variable concentration of nitrogen, the method including the simultaneous steps of: (A) passing the mixed methane gas feed stream through a first heat exchanger and then through a second heat exchanger to condense at least a portion of the mixed methane gas feed stream, the first heat exchanger using a first cryogenic refrigerant and the second heat exchanger using a second cryogenic refrigerant; (B) sending the mixed methane gas feed stream coming out of the second heat exchanger through a mid-level inlet of a fractional distillation column to separate the mixed methane gas feed stream into a methane-rich liquid fraction and a nitrogen-rich gas fraction; (C) withdrawing the methane-rich liquid fraction accumulating at a bottom of the fractional distillation column through a bottom outlet, the methane-rich liquid fraction constituting the LMG; (D) passing the LMG withdrawn from the bottom outlet in step (C) through a third heat exchanger to further cool the LMG; (E) withdrawing the nitrogen-rich gas fraction at a top of the fractional distillation column through a top outlet; (F) passing the nitrogen-rich gas fraction through a fourth heat exchanger and then through a fifth heat exchanger, the fourth heat exchanger using the first cryogenic refrigerant and the fifth heat exchanger using the second cryogenic refrigerant, at least a portion of the nitrogen-rich gas fraction undergoing a phase change to a liquid phase inside the fifth heat exchanger; (G) introducing the nitrogen-rich gas fraction coming out of the fifth heat exchanger into a nitrogen phase separator vessel where the liquid phase is separated from a gas phase; (H) withdrawing the liquid phase accumulating at a bottom of the nitrogen phase separator vessel and introducing the withdrawn liquid phase by gravity into the fractional distillation column as a reflux stream through an overhead inlet located above the mid-level inlet and below the top outlet; (I) withdrawing the gas phase from a top of the nitrogen phase separator vessel and passing the withdrawn gas phase directly into an expansion valve; (J) using the expanded gas coming out of the expansion valve as the first cryogenic refrigerant, the first cryogenic refrigerant circulating in an open-loop first refrigerant circuit originating at an outlet of the expansion valve and then passing through, in succession, the fourth heat exchanger and the first heat exchanger; (K) venting the first cryogenic refrigerant, coming from the first heat exchanger, out of the first refrigerant circuit; and (L) circulating the second cryogenic refrigerant in a closed-loop second refrigerant circuit, the second refrigerant circuit extending from an independent cryogenic refrigeration system to the fifth heat exchanger, from the fifth heat exchanger to the third heat exchanger, from the third heat exchanger to the second heat exchanger, and then from the second heat exchanger back to the independent cryogenic refrigeration system.

In another aspect, there is provided an arrangement for continuously producing a liquefied methane gas (LMG) from a pressurized mixed methane gas feed stream, the mixed methane gas feed stream containing methane and a variable concentration of nitrogen, the arrangement including: a fractional distillation column having a top outlet, a bottom outlet, a mid-level inlet and an overhead inlet located above the mid-level inlet and below the top outlet; a mixed methane gas feed stream circuit for a mixed methane gas feed stream, the mixed methane gas feed stream circuit extending, in succession, between an inlet of the mixed methane gas feed stream circuit, a first heat exchanger, a second heat exchanger, and the mid-level inlet of the fractional distillation column; a liquid methane gas (LMG) circuit, the LMG circuit extending between the bottom outlet of the fractional distillation column, a third heat exchanger, and an outlet of the LMG circuit; a nitrogen phase separator vessel having a mid-level inlet, a top outlet and a bottom outlet, the bottom outlet of the nitrogen phase separator vessel being in fluid communication with and positioned vertically above the overhead inlet of the fractional distillation column; an expansion valve in direct fluid communication with the top outlet of the nitrogen phase separator vessel; an opened-loop first refrigerant circuit for a first cryogenic refrigerant, the first refrigerant circuit extending, in succession, between an outlet of the expansion valve, a fourth heat exchanger, the first heat exchanger and a venting outlet of the first refrigerant circuit; a closed-loop second refrigerant circuit for a second cryogenic refrigerant, the second refrigerant circuit being in fluid communication with an inlet and an outlet of an independent cryogenic refrigeration system, the second refrigerant circuit extending, in succession, between the outlet of the independent cryogenic refrigeration system, a fifth heat exchanger, the third heat exchanger, the second heat exchanger and the inlet of the independent cryogenic refrigeration system; and a nitrogen-rich gas fraction circuit extending, in succession, between the top outlet of the fractional distillation column, the fourth heat exchanger, the fifth heat exchanger and the mid-level inlet of the nitrogen phase separator vessel.

Further details on the various aspects and features of the proposed concept will be apparent from the following detailed description and the appended figures.

DETAILED DESCRIPTION

Figure 1:
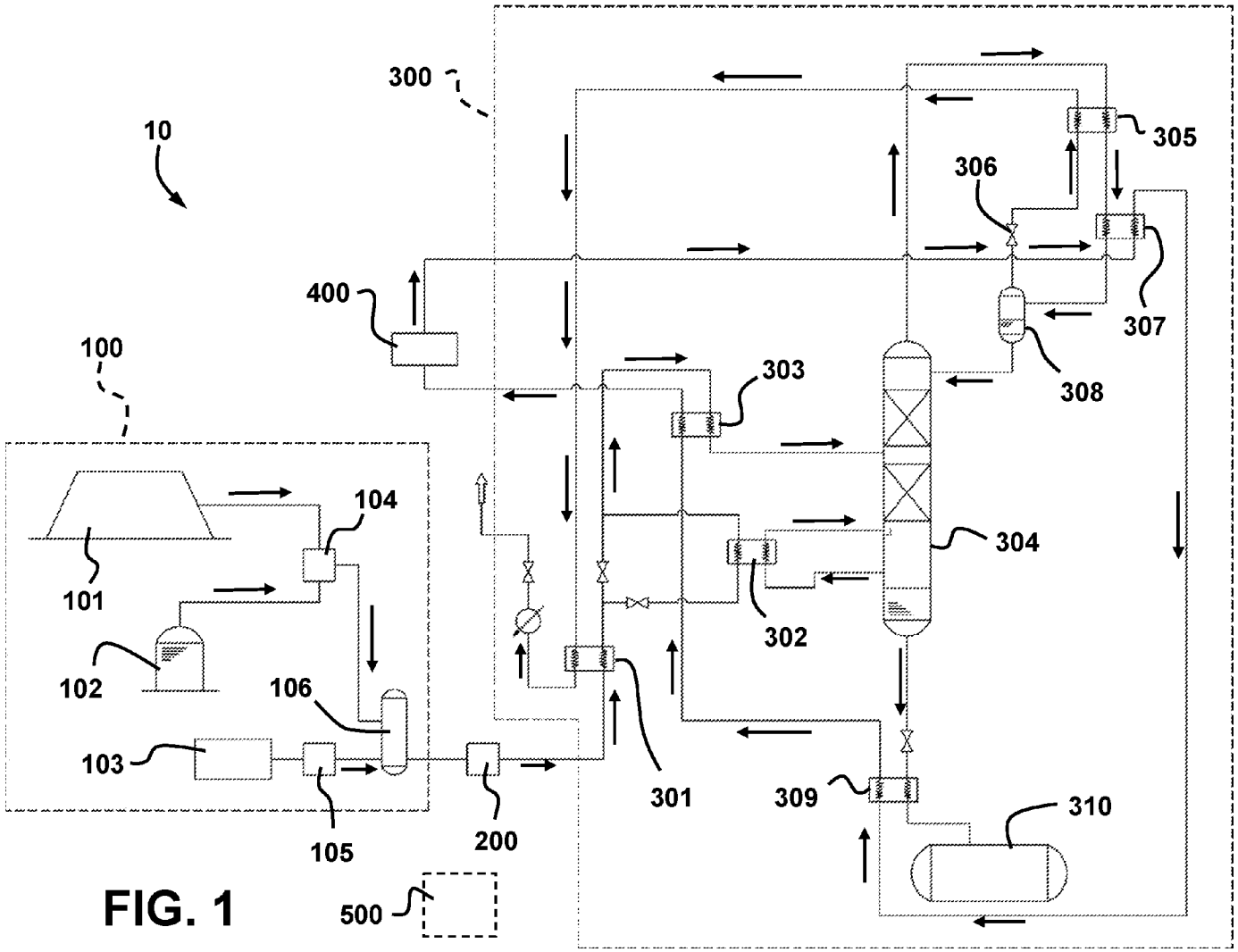
FIG. 1 is a semi-schematic view of an example of a LMG production arrangement in accordance with the proposed concept.

FIG. 1 is a semi-schematic view of an example of a Liquefied Methane Gas (LMG) production arrangement 10 in accordance with the proposed concept. It is illustrated as a simplified flow diagram. This arrangement 10 results from the integration of five different systems that are interconnected through a plurality of lines or pipes. It is designed to produce LMG using a methane gas feed stream that can be a mixture of gases from different gas sources. FIGS. 2 to 5 illustrate details of examples of the systems provided in the LMG production arrangement 10 of FIG. 1. Variants are possible as well.

Those skilled in the art will recognize that FIGS. 1 to 5 are only showing some of the components that would be found in an actual commercial plant. Other components have been omitted for the sake of clarity. They may include, for example, pumps, valves, sensors, actuator motors and/or filters, to name just a few. These other components will generally be included in actual implementations in accordance with standard engineering practice. They need not be described herein to gain and appreciate a full understanding of the proposed concept by those skilled in the art.

As used herein, the term "biogas" refers to a gas generated by the biodegradation of organic matter, for instance gas coming from a landfill site, an anaerobic digester, or any other similar suitable source of methane gas other than natural gas.

As used herein, the expression "alternate source of methane gas" generally refers to any suitable source of gas comprising mostly methane, for instance a methane gas concentration of 85% vol. Variants are possible.

As used herein, the expression "mixed methane gas feed stream" as well as other related words and expressions generally refer to a methane gas feed stream coming from a variety of possible sources at the inlet of the system. However, this does not imply that the methane gas needs to be a mixture of gases from two or more different sources at any given moment. It is possible to have methane gas coming from only one of the sources during a certain time and this gas stream will still be referred to as the "mixed methane gas feed stream" in the context.

As used herein the expression "nitrogen being substantially absent from the mixed methane gas feed stream" generally refers to a very low concentration of nitrogen in the mixed methane gas feed stream that does not necessitate nitrogen to be removed when the methane gas content is transformed into LMG and to a concentration of nitrogen that is insufficient for using the nitrogen gas content as a refrigerant. Nitrogen is generally considered to be substantially absent from the mixed methane gas feed stream when the nitrogen concentration is below about 4% vol., preferably below about 3% vol. The exact value, however, can vary slightly from one implementation to another. Nitrogen is considered to be present in the mixed methane gas feed stream when the nitrogen concentration is not below the given threshold value.

From now on, including in the claims, all numerical values must be considered as if the word "about" is always placed before them. This word was omitted only for the sake of simplicity. The word "about" generally means plus or minus 10%, including elsewhere in the specification. This applies to temperature values, pressure values, concentration values, flow rate values, mass flow rate values, etc.

The arrangement 10 of FIG. 1 includes a gas supply system 100. The gas supply system 100 outputs the mixed methane gas feed stream that will be used for producing LMG. The gases in the gas supply system 100 flow through a network of lines and pipes providing a fluid communication between the various components. The content of the mixed methane gas feed stream can come from one or more of the available sources. In the illustrated example, one of these sources is a landfill site 101 and another is an anaerobic digester 102. Both are capture points. In a landfill site, a mixture of raw biogas and leachate generally enters these capture points and are collected using a network of conduits provided across the landfill site 101. Once captured, biogas is sent to a biogas compression, control and primary treatment subsystem 104. This subsystem 104 can include, for instance, one or more hydrostatic multi-phase separators, such as those shown and described in the Canadian Patent No. 2,766,355 (Tremblay et al.) of 2012, which is hereby incorporated by reference in its entirety. Canadian Patent No. 2,766,355 disclose how the leachate portion of the mixture can be separated from the gas portion. Variants are possible as well.

The subsystem 104 may include a low pressure compressor and a corresponding gas cooling unit. The low pressure compressor increases the pressure of the biogas, for instance to 100 kPag. Other pressure values are possible as well. In the illustrated example, the biogas coming from the landfill site 101 and the biogas coming from the anaerobic digester 102 are both compressed and cooled by the same equipment. Variants are possible as well.

The subsystem 104 may include an absorption acid gas removal device operating at a relatively low pressure, for example a pressure of less than 100 kPag (15 psig). This absorption acid gas removal device can use an aqueous amine solvent to remove carbon dioxide and hydrogen sulfide as a result of a chemical reaction process. The carbon dioxide concentration can be kept under 2% vol. Variants are possible as well.

The pretreated biogas coming out of the subsystem 104 can be mixed with methane gas from an alternative source. In the illustrated example, the alternative source of methane gas is a natural gas pipeline 103 from which pressurized natural gas can be obtained. This alternate source of methane gas is used mainly to supply methane gas if biogas cannot meet the demand. As aforesaid, the methane gas fraction in the biogas coming from landfill sites often continuously fluctuates and it may even fall too low for the amount of LMG to be produced. Biogas will generally be used in priority but if not sufficient, the alternative source of methane gas will compensate for the shortages. The missing methane gas fraction can then be obtained from the alternate source of methane gas until it is no longer needed. Other possible situations include a sudden rise in the demand in LMG. The alternate source of methane gas can be used to supply the missing methane gas portion.

If desired, some implementations can be designed for use with only one possible source of biogas instead of two, as shown. Additional sources of biogas and/or additional alternate sources of methane gas can be provided. If desired, the natural gas pipeline can also be replaced by a storage tank or the like.

In the illustrated example, the outlet of the natural gas pipeline 103 is connected to a natural gas control device 105. The device 105 controls the supply and flow rate of the natural gas coming from the natural gas pipeline 103. The biogas and/or the natural gas, depending on the source or sources being used, is mixed into a methane gas mixing vessel 106. Variants are possible as well.

Gas coming out of the methane gas mixing vessel 106 is supplied to a gas treatment system 200 in which some undesirable components are removed. These include, for instance, carbon dioxide, hydrogen sulfide (often called acid gases), siloxanes, VOC and mercury. Variants are possible as well.

Figure 2:
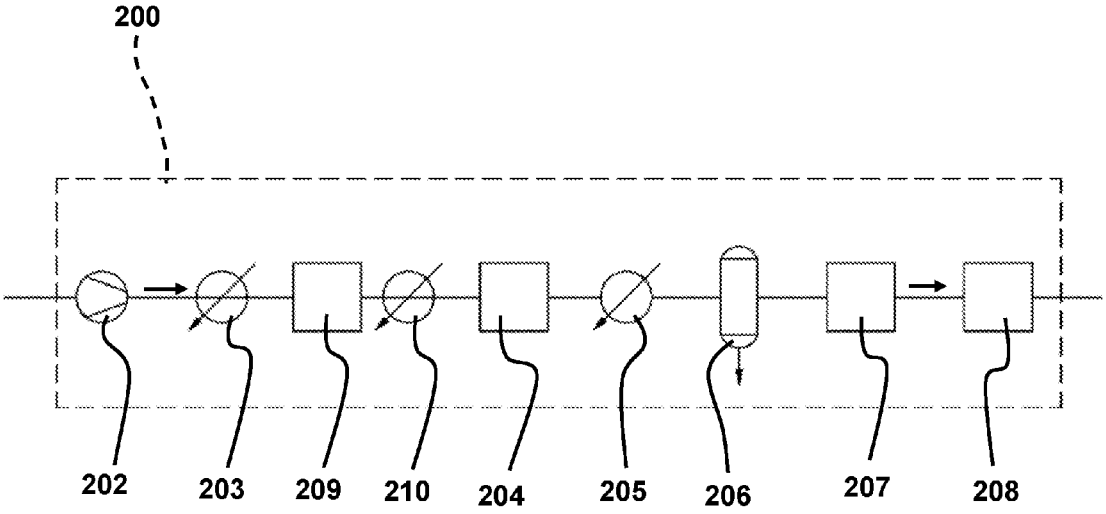
FIG. 2 is an enlarged semi-schematic view illustrating details of the example of the gas treatment system provided in the LMG production arrangement of FIG. 1.

FIG. 2 is an enlarged semi-schematic view illustrating details of the example of the gas treatment system 200 provided in the LMG production arrangement 10 of FIG. 1. In this example, the mixed methane gas feed stream from the system 100 is supplied through a high pressure compressor 202. The expression "high pressure" used in the context of this compressor generally refers to the highest pressure in the arrangement 10. The pressure range will generally be from 1,380 kPag to 2,070 kPag. Other values are possible. However, as can be seen, the magnitude of these pressures is significantly lower than the magnitude of the pressures involved in many existing arrangements. Using pressures within these lower pressure ranges will considerably decrease the costs of the compressor 202 and its energy consumption. It should be noted that depending on the implementation, the compressor 202 can either be a single compressor or a unit integrating two or more compressors. Both situations are covered within the meaning of the word "compressor", even if used in a singular form.

In the illustrated example, the mixed methane gas feed stream goes from the compressor 202 through a unit 203 that is positioned immediately downstream the compressor 202. The unit 203 can be a combined gas cooler and two-phase separator. It lowers the temperature of the mixed methane gas feed stream, for instance down to a temperature of 30° C. Other values are possible. This lower temperature is also used for removing a large part of the water therein since water will condense at this temperature due to the high gas pressure. Water is separated from the rest of the mixed methane gas feed stream using the two-phase separator integrated into the unit 203. Residual water, however, may still be present.

In the illustrated example, the mixed methane gas feed stream goes from the unit 203 to an absorption acid gas removal subsystem 209 to remove carbon dioxide and hydrogen sulfide as a result of a chemical reaction process. Variants are possible as well. Unlike the absorption acid gas removal device in the primary treatment subsystem 104, this subsystem 209 operates at high pressure. The absorption acid gas removal device in the primary treatment subsystem 104 is complementary and since it operates at a lower pressure, the operation costs are lower. Overall, it is generally desirable that at the output of the gas treatment system 200, the carbon dioxide concentration be under 50 ppmv and the hydrogen sulfide concentration be under 2 ppmv. Variants are possible as well.

In the illustrated example, the mixed methane gas feed stream goes from the subsystem 209 to another combined gas cooler and two-phase separator 210. Then, the mixed methane gas feed stream of the example is then sent to a gas dehydrator 204 to remove residual water, if any. The gas dehydrator 204 can include, for instance, a multi-bed regenerative subsystem using a molecular sieve or the like. Variants are possible as well.

Still, in the illustrated example, the mixed methane gas feed stream goes from the outlet of the gas dehydrator 204 to a gas precooling unit 205. In this example, the gas precooling unit 205 has two main functions: the first is to provide a precooling of the mixed methane gas feed stream to further decrease its temperature, for example down to a temperature of −40° C. Other values are possible. The second function is the condensation of siloxanes and some of the VOC that may still be present in the mixed methane gas feed stream. The precooled gas stream containing droplets of condensed siloxanes and VOC is then sent to a gas phase-separator vessel 206 containing, for instance, coalescing filters provided to remove substantially all the condensed gas droplets. Variants are possible as well.

The mixed methane gas feed stream exiting the gas phase-separator vessel 206 of the illustrated system 200 is fed to a primary absorption receiver 207. The primary absorption receiver 207 of this example can remove any residual siloxanes and at least some of the VOC from the mixed methane gas feed steam. The primary absorption receiver 207 can include, for instance, at least one sorbic bed of activated carbon or the like. Variants are possible as well.

Afterwards, the mixed methane gas feed stream exiting the primary absorption receiver 207 of the illustrated system 200 is then fed to a secondary absorption receiver 208 to remove any residual mercury. The secondary absorption receiver 208 can include, for instance, at least one sorbic bed of sulfur impregnated activated carbon or the like. Variants are possible as well.

The mixed methane gas feed stream coming out of the system 200 is now ready to enter the LMG production and nitrogen rejection system 300. At this point, the pressurized mixed methane gas feed stream contains mostly methane and possibly nitrogen. Nitrogen will generally have a possible concentration between one where nitrogen is totally or almost totally absent and 50% vol. The very low nitrogen concentrations would occur, for instance, when the gas comes only from the alternative source of methane gas, such as the natural gas pipeline 103.

Figure 3:
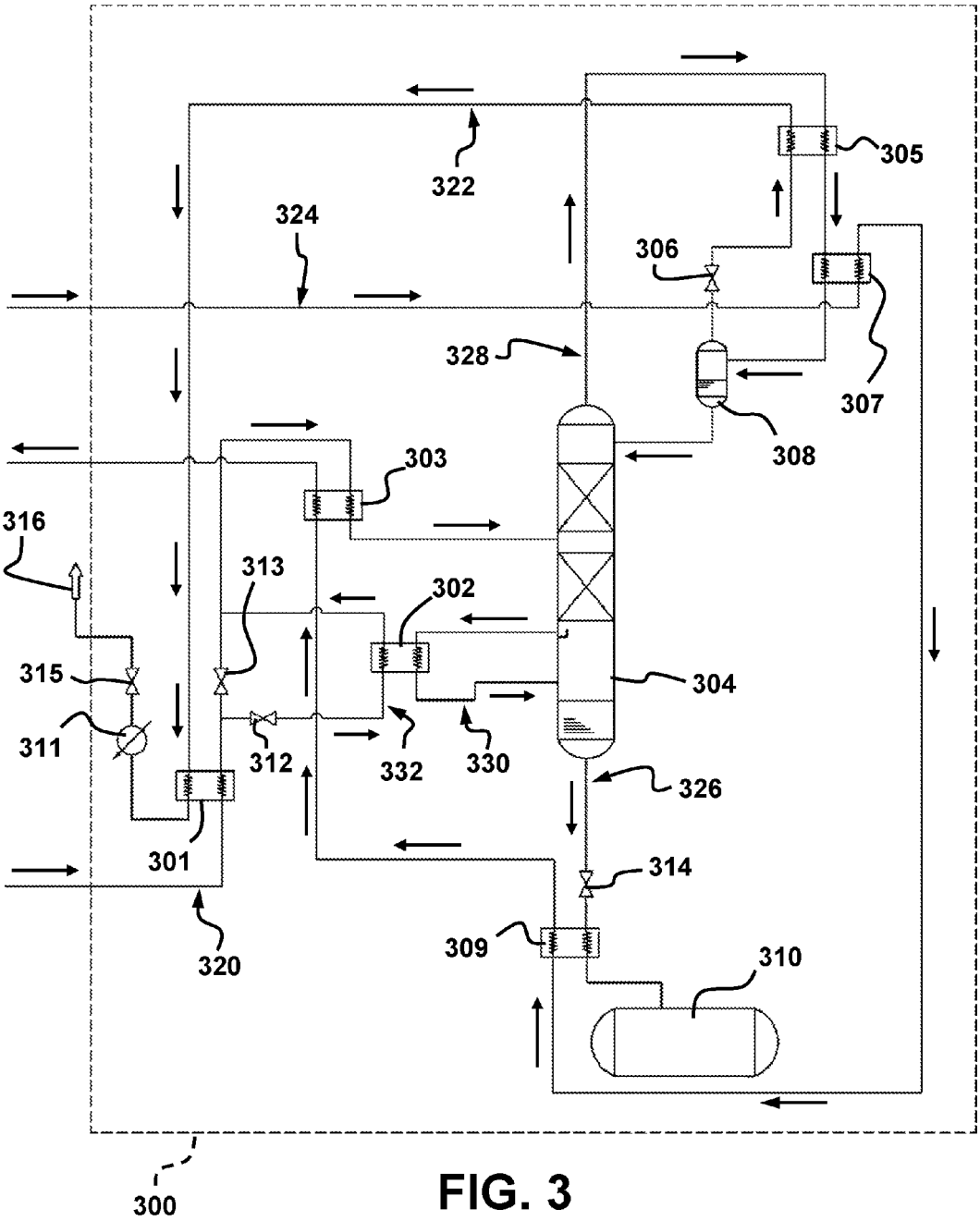
FIG. 3 is an enlarged semi-schematic view illustrating details of the example of the LMG production and nitrogen rejection system provided in the LMG production arrangement of FIG. 1.

FIG. 3 is an enlarged semi-schematic view illustrating details of the example of the LMG production and nitrogen rejection system 300 provided in the LMG production arrangement 10 of FIG. 1. As can be seen, the system 300 includes various components to condense the methane gas, separate the nitrogen (if required) from the condensed methane gas, and cool the condensed purified methane gas product, constituting at that point the LMG, down to a storage temperature. The system 300 is well integrated with the other systems in the arrangement 10 in order to improve the efficiency of the whole process.

As can be seen, the system 300 includes a fractional distillation column 304.

The mixed methane gas feed stream is carried in the system 300 through a mixed methane gas feed stream circuit 320. This circuit 320 includes a network of lines and pipes. The mixed methane gas feed stream enters the system 300 at an inlet of the circuit 320 and then passes, in succession, at least through a first heat exchanger 301 and a second heat exchanger 303. Thus, the second heat exchanger 303 is located downstream the first heat exchanger 301. The circuit 320 goes from the outlet of the second heat exchanger 303 to a mid-level inlet of a fractional distillation column 304. Before entering the fractional distillation column 304, the mixed methane gas feed stream is cooled down to a cryogenic temperature. The cryogenic temperature will condense the methane gas in the second heat exchanger 303, for example to −120 to −140° C., typically −130° C. Most of the nitrogen, if any is present in the mixed methane gas feed stream, will still be in a gaseous form at the outlet of the second heat exchange 303 before its introduction in the mid-level inlet of the fractional distillation column 304. Therefore, the fractional distillation column 304 makes a separation of the two fractions, one being a methane-rich liquid fraction and the other being a nitrogen-rich gas fraction. The methane-rich liquid fraction will accumulate at the bottom of the fractional distillation column 304 and can be withdrawn through a bottom outlet of the fractional distillation column 304. This methane-rich liquid fraction constitutes the LMG. With the system 300, the LMG output can always be substantially exempt of nitrogen, for example with a maximum concentration in the order of 1 to 3% vol.

The system 300 also includes a LMG circuit 326. This circuit 326 has a number of lines or pipes to convey the LMG. From the bottom outlet of the fractional distillation column 304, the LMG circuit 326 passes through a third heat exchanger 309 that is provided to further cool the LMG to its final conditions, for example a temperature of −160° C. In the illustrated example, the LMG circuit 326 ends at a storage tank 310 in which it can stored and eventually be pumped to a potential user of the LMG. The flow of the LMG exiting the bottom outlet of the fractional distillation column 304 is controlled by the LMG flow control valve 314. Variants are possible as well.

The system 300 further includes a nitrogen-rich gas fraction circuit 328. It includes a number of lines or pipes to convey a nitrogen-rich gas fraction captured at a top outlet of the fractional distillation column 304. From this top outlet, the circuit 328 passes through, in succession, a fourth heat exchanger 305 and a fifth heat exchanger 307. It ends at a mid-level inlet of a nitrogen phase separator vessel 308. This nitrogen phase separator vessel 308 also includes a bottom outlet and a top outlet. The bottom outlet is in fluid communication with and positioned vertically above an overhead inlet of the fractional distillation column 304. Variants are possible as well.

The various heat exchangers of the system 300 use two distinct refrigerant circuits. An indirect heat exchange is carried out in each of these heat exchangers since no mixing of the fluids occur therein. All the heat exchangers of the system 300 are preferably of standard copper brazed plate type. Variants are possible as well.

The first refrigerant circuit 322 of the arrangement 10 is an opened-loop refrigerant circuit for a first cryogenic refrigerant. Nitrogen coming out of the top outlet of the nitrogen phase separator vessel 308 constitutes this first cryogenic refrigerant. The first cryogenic refrigerant only passes once through the first refrigerant circuit 322. It passes, in succession, through an expansion valve 306, the fourth heat exchanger 305 and the first heat exchanger 301. It ultimately goes out of the first refrigerant circuit 322 through a venting outlet 316.

In the illustrated example, the venting outlet 316 vents the nitrogen directly into the atmosphere but it will be almost exempt from methane gas, for example less than 1% vol. The goal is to bring the methane gas concentration as low as possible, preferably below 2% vol. and even more preferably 1% vol. in the venting outlet 316. This will mitigate the loss of methane gas and therefore maximize the amount of LMG being produced.

The flow rate of nitrogen gas at the venting outlet 316 of the circuit 322 is controlled by the nitrogen vent control valve 315. Prior to passing through control valve 315, the cold energy of the cold nitrogen gas stream is recovered by the nitrogen heat recovery exchanger 311. The hot side of the nitrogen heat recovery exchanger 311 can be in fluid communication with a cooling system requiring some free cooling at the temperature conditions of the nitrogen cold side, for instance a glycol cooling system used for compressor cooling applications. Variants are possible as well. For instance, the nitrogen gas could be used for another purpose in the plant instead of being vented directly in the atmosphere.

As can be seen, the expansion valve 306 is in direct fluid communication with the top outlet of the nitrogen phase separator vessel 308. The expansion valve 306 can be for instance a Joule-Thomson control valve into which the pressure is greatly reduced between the inlet and the outlet of the expansion valve 306. The outlet pressure can be, for example, between 70 to 170 kPag, generally from 100 kPag, before being fed into the cold side of the fourth heat exchanger 305.

The second refrigerant circuit 324 is a closed-loop circuit provided for a second cryogenic refrigerant. This second refrigerant circuit 324 is separated from the first refrigerant circuit 322. As can be seen, the second refrigerant circuit 324 is in fluid communication with an inlet and an outlet of an independent cryogenic refrigeration system 400. The second cryogenic refrigerant at its coldest temperature is first supplied through the inlet of the fifth heat exchanger 307. The second cryogenic refrigerant exits the fifth heat exchanger 307 and is supplied to the cold side of the third heat exchanger 309. The second cryogenic refrigerant exits the third heat exchanger 309 and is supplied to the cold side of the second heat exchanger 303. The second cryogenic refrigerant exits the second heat exchanger 303 to be returned to the inlet of the independent cryogenic refrigeration system 400.

In use, at least a portion of the nitrogen-rich gas fraction coming out of the top outlet of the fractional distillation column 304 undergoes a phase change to a liquid phase inside the fifth heat exchanger 307. A portion of the nitrogen-rich gas fraction can also undergo a phase change to a liquid phase inside the fourth heat exchanger 305.

The illustrated system 300 further includes a sixth heat exchanger 302 and a reboiler circuit 330 that is in fluid communication with the interior of the fractional distillation column 304. The reboiler circuit 330 passes through the sixth heat exchanger 302 in which the reboiler circuit 330 is in indirect heat exchange relationship with at least a portion of the mixed methane gas feed stream coming from a by-pass circuit 332. The by-pass circuit 332 has an inlet and an outlet that are both provided, on the mixed methane gas feed stream circuit 320, downstream the first heat exchanger 301 and upstream the second heat exchanger 303. The reboiler circuit 330 has an inlet that is vertically above the outlet in the fractional distillation column 304. In use, a portion of the mixed methane gas feed stream can be circulated from inside the fractional distillation column 304 through the reboiler circuit 330. The flow of main gas stream supplied to the sixth heat exchanger 302 is controlled by two flow control valves, the LMG reboiler control valve 312 and the LMG bypass control valve 313.

While the methane rich liquid flows by gravity through the internal packing of the fractional distillation column 304, upward methane gas will separate nitrogen gas from the methane-rich liquid fraction going down the fractional distillation column 304. Residual methane gas present into the nitrogen-rich gas fraction rising into the fractional distillation column 304 is liquefied using the cold liquid reflux stream supplied at the top of the fractional distillation column 304 and coming from the nitrogen phase separator vessel 308. The reflux stream content includes liquid methane and liquid nitrogen.

Figure 4:
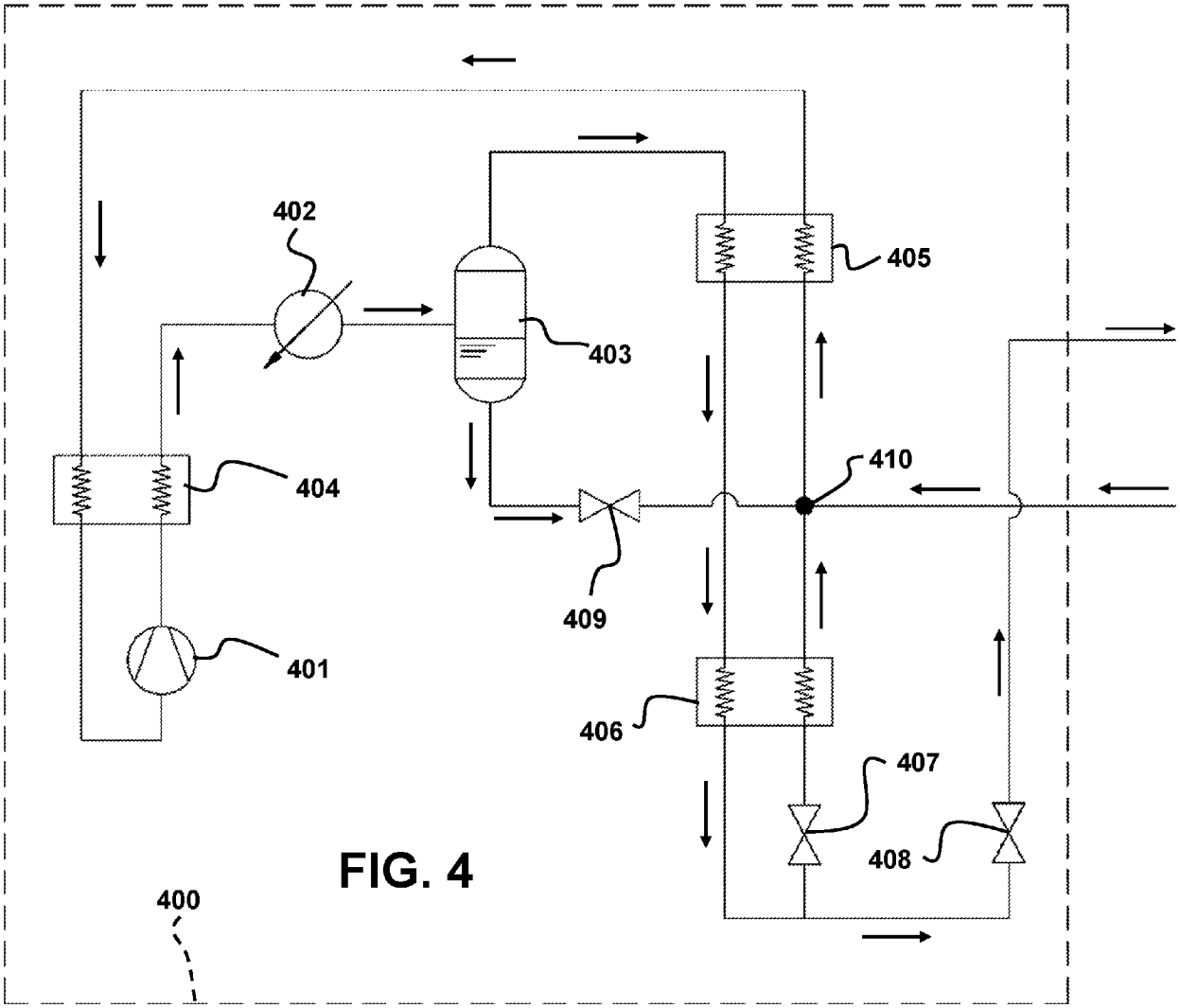
FIG. 4 is an enlarged semi-schematic view illustrating details of the example of the independent cryogenic refrigeration system provided in the LMG production arrangement of FIG. 1.

FIG. 4 is an enlarged semi-schematic view illustrating details of the example of the independent cryogenic refrigeration system 400 provided in the LMG production arrangement 10 of FIG. 1. As aforesaid, the system 400 provides the second cryogenic refrigerant, which can be a multicomponent refrigerant cooled by a conventional two-flow plate heat exchangers and using a conventional oil lubricated compressor, for instance as disclosed in U.S. Pat. No. 6,751,984 (Neeraas et al.) of 2004, which is hereby incorporated by reference in its entirety. Other systems or kinds of systems can be used as well.

In the illustrated system 400, there is provided a compressor 401, a refrigerant cooler 402, a phase-separator vessel 403, first secondary heat exchanger 404, a second secondary heat exchanger 405, a primary heat recovery exchanger 406, control valves 407, 408, 409 and a refrigerant mixer 410. Variants are possible.

Figure 5:
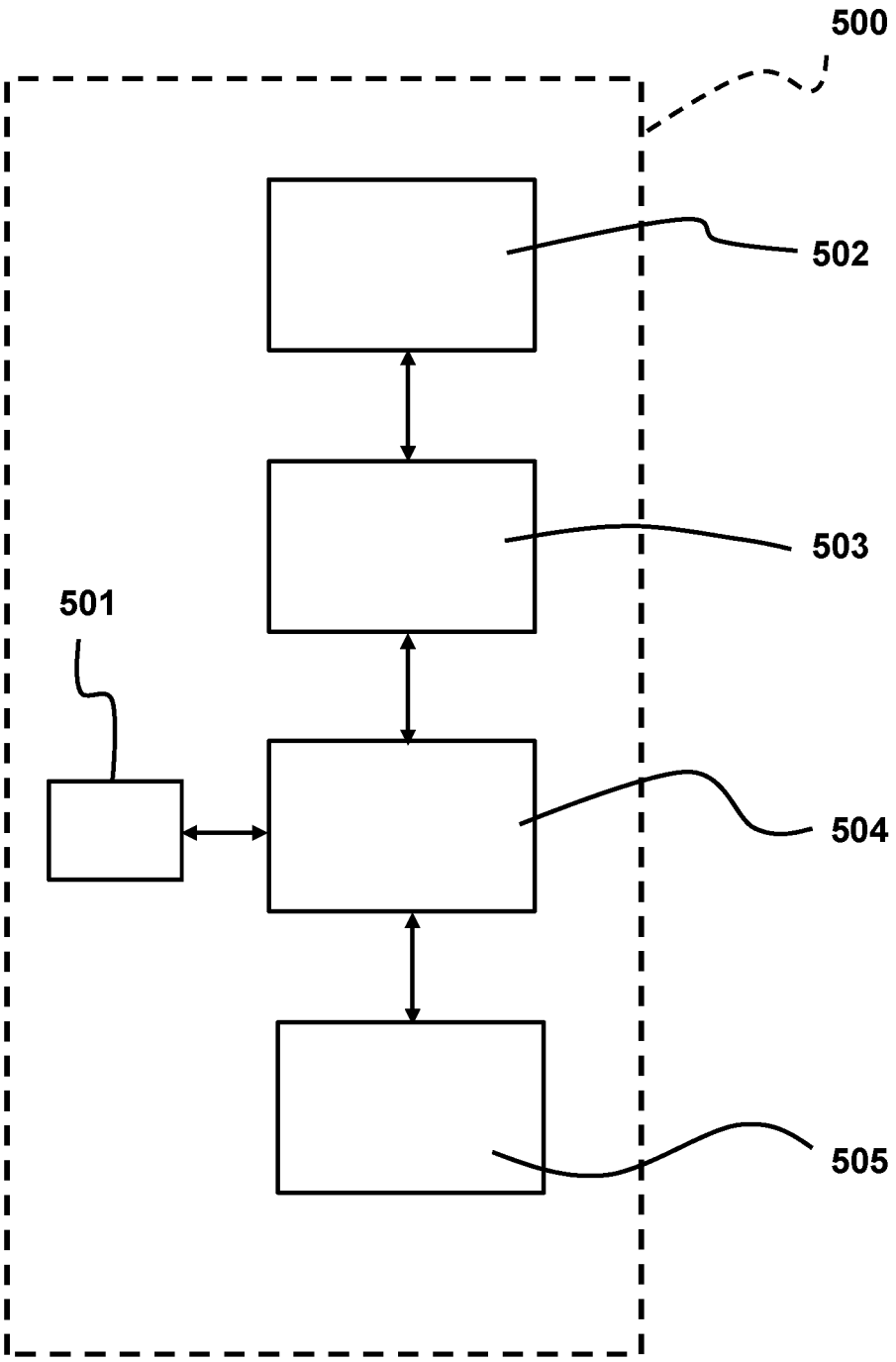
FIG. 5 is a simplified block diagram illustrating details of the example of the control system provided in the LMG production arrangement of FIG. 1.

FIG. 5 is a simplified block diagram illustrating details of the example of the control system 500 provided in the LMG production arrangement 10 of FIG. 1. Other kinds of configurations are possible as well.

As can be seen, the illustrated control system 500 includes a LMG demand controller 501, a methane gas supply controller 502, a gas treatment system controller 503, the LMG production and nitrogen rejection system controller 504 and the independent cryogenic refrigeration system controller 505.

The controller 502 can actuate the mixed methane gas feed stream quality and quantity to satisfy the LMG demand controller 501. The controller 502 can receive signals from different sensors and generate signals to various components, such as compressor motor, valves, etc. Signals can also be exchanged between the controller 502 and the other controllers 501, 503, 504, 505. Variants are possible as well.

The controller 503 provides the gas treatment quality control to satisfy the LMG demand controller 501. The controller 503 can receive signals from various sensors and can send signals, for instance to the motor of the high pressure compressor 202 and others. Signals may also be exchanged between the controller 503 and the other controllers 501, 502, 504, 505. Variants are possible as well.

The controller 504 provides the LMG production and nitrogen rejection system control to satisfy the LMG demand controller 501. The controller 504 can receive signals from various sensors and can send signals, for instance to the LMG reboiler control valve 312, the LMG reboiler bypass control valve 313, the expansion valve 306, the LMG flow control valve 314, the nitrogen vent control valve 315 and also to various other control commands. Signals are also be exchanged between the controller 504 and the other controllers 501, 502, 503, 505. Variants are possible as well.

The controller 505 can provide the independent cryogenic refrigeration system 400 some control to satisfy the LMG demand controller 501. The controller 505 can receive signals from various sensors and others. Signals are also exchanged between the controller 505 and the other controllers 501, 502, 503, 504. Variants are possible as well.

If desired, the various controllers 501, 502, 503, 504, 505 can be programmed into one or more general purpose computers, dedicated printed circuit boards and/or other suitable devices otherwise configured to achieved the desired functions of receiving the data and sending command signal. Depending on the implementation, the five controllers 501, 502, 503, 504, 505 can be separate devices and/or can be integrated into one or more single device. Each controller 501, 502, 503, 504, 505 would then be, for instance, a portion of the software code loaded into the device. Each controller may include a control/display interface to access the control system 500. Variants are possible.

EXAMPLES

The following are non-limiting examples, obtained from computer simulations, to show the same system processing a mixed methane gas feed stream having different methane gas and nitrogen gas contents. In all cases, it is possible to produce LMG with the same quality while rejecting nitrogen gas with only 1% vol. of methane gas or less at the venting outlet 316.

First Example

In this first example, the mixed methane gas feed stream includes gas coming only from an alternative source of methane gas, such as the natural gas pipeline 103 where the nitrogen gas content is less than 3% vol. The LMG demand controller 501 has a set point of 1.0 ton per day of LMG and the goal is to obtain LMG containing a maximum concentration of 3% vol. of nitrogen. A mass flow rate of 5,600 lbmoles per hour of mixed methane gas feed is supplied to the system 300 at −40° C. and 1,724 kPag. This mixed methane gas feed stream goes through the second heat exchanger 303 from which it exits at −135° C. and 1,586 kPag to be supplied at the mid level inlet of the fractional distillation column 304. Since the nitrogen gas content of this mixed methane gas feed stream is less than 3% vol., no distillation takes place and nothing is withdrawn from the top outlet of the fractional distillation column 304. Hence, there are no flow of gas into the fourth heat exchanger 305, the expansion valve 306 and no reflux stream returns to the fractional distillation column 304.

The liquefied stream entering the fractional distillation column 304 at the mid-level inlet falls to the bottom. It is later supplied the third heat exchanger 309 from which it exits with a mass flow rate of 5,600 lbmoles per hour to be stored into the LMG storage tank 310 at −160° C. and a storage pressure of 1,538 kPag. To perform this liquefaction process, the second cryogenic refrigerant exits the system 400 at 169 kPag and −177° C. This second cryogenic refrigerant exits the fifth heat exchanger 307 at 159 kPag and the same temperature of −177° C. to be supplied to the third heat exchanger 309 from which it exits at 159 kPag and −156° C. The second cryogenic refrigerant exits to be supplied to the second heat exchanger 303 from which it exits at 149 kPag and −107° C. It then returns to the system 400 to be cooled before returning to the system 300.

Second Example

In this second example, only biogas is used in the system 100. This biogas has a composition equivalent to a medium biogas composition. It contains 47.9% vol. of methane gas, 35.8% vol. of carbon dioxide, 16% vol. of nitrogen and 0.3% vol. of oxygen. The biogas has a flow rate of approximately 146 $Nm^3$ per hour of biogas. It is supplied to the system 200 in which carbon dioxide, oxygen, water vapor and other minor gases are removed.

After the gas treatment in the system 200, the mixed methane gas feed stream supplied to the system 300 has a composition of 75% vol. of methane gas and 25% vol. of nitrogen gas. The LMG demand controller 501 has a set point of 1.0 ton per day of LMG containing a maximum nitrogen concentration of 3% vol. A mass flow rate of 7,265 lbmoles per hour of mixed methane gas is supplied to the system 300 at −40° C. and 1,724 kPag. This gas stream is supplied to the second heat exchanger 303 from which it exits at −135° C. and 1,586 kPag to be supplied at an intermediate location into the fractional distillation column 304. A purified LMG product stream containing 97% vol. of methane and 3% vol. of nitrogen is withdrawn at 1,606 kPag and −115° C. It is supplied to the third heat exchanger 309 from which it exits with a mass flow rate of 5,600 lbmoles per hour to be stored into the LMG storage tank 310 at −160° C. and a storage pressure of 1,538 kPag or less.

Since the nitrogen concentration in the feed gas is more than 3% vol., some distillation will automatically occur in the fractional distillation column 304. Some gas will be feed to the sixth heat exchanger 302 to supply methane gas into the fractional distillation column 304. The nitrogen-rich gas fraction is withdrawn from the fractional distillation column 304 containing 97.22% vol. of nitrogen and 2.78% vol. of methane gas at 1,544 kPag and −159° C. This nitrogen gas depressurizes through the expansion valve 306 and exits at 172 kPag and −184° C. The partly condensed nitrogen-rich gas fraction is further condensed in the fifth heat exchanger 307 from which it exits at 1,544 kPag and −160° C. It enters the nitrogen phase-separator vessel 308 in which the liquid and the vapor are separated. The liquid reflux stream returns into the top portion of the fractional distillation column 304 with a mixture containing 96% vol. of nitrogen and 4% vol. of methane at 1,544 kPag and −160° C.

At the outlet of the first refrigerant circuit 322, the nitrogen gas stream is sent to a nitrogen heat recovery exchanger 311 from which it exits at a flow rate of 1,665 lbmoles per hour containing 99% vol. of nitrogen gas and 1% vol. of methane gas at 103 kPag and −45° C.

The second cryogenic refrigerant from the system 400 has the same composition as in the first example. It is supplied at the inlet of the fifth heat exchanger 307 at 113 kPag and −181° C. This second cryogenic refrigerant exits the fifth heat exchanger 307 at 103 kPag and −171° C. to be supplied to the third heat exchanger 309 from which it exits at 103 kPag and −155° C. The second cryogenic refrigerant then goes through the second heat exchanger 303 from which it exits at 93 kPag and −122° C. It then returns to the system 400 to be cooled before returning to the system 300.

Third Example

In this third example, only biogas is also used in the system 100. This biogas, however, has a lean biogas composition. It contains 33.1% vol. of methane gas, 39.6% vol. of carbon dioxide, 27% vol. of nitrogen and 0.3% vol. of oxygen. The third example uses a flow rate of approximately 212 $Nm^3$ per hour of biogas being supplied to the system 200. The system 200 removes carbon dioxide, oxygen, water vapor and other minor gases.

After the gas treatment in the system 200, the mixed methane gas feed stream supplied to the system 300 has a composition of 55% vol. of methane gas and 45% vol. of nitrogen gas. The LMG demand controller 501 has a set point of 1.0 ton per day of LMG containing a maximum nitrogen concentration of 3% vol. A mass flow rate of 9,956 lbmoles per hour of feed gas is supplied to the system 300 at −40° C. and 1,724 kPag. This gas is supplied to the second heat exchanger 303 from which it exits at −135° C. and 1,586 kPag to be supplied at an intermediate location into the fractional distillation column 304. A purified LMG product stream containing 97% vol. of methane and 3% vol. of nitrogen is withdrawn at 1,606 kPag and −115° C. and is supplied to the third heat exchanger 309 from which it exits with a mass flow rate of 5,600 lbmoles per hour to be stored into the LMG storage tank 310 at −160° C. and a storage pressure of 1,538 kPag.

Since the nitrogen concentration in the mixed methane gas feed stream is more than 3% vol., some distillation will automatically occur in the fractional distillation column 304. The performance of the distillation process will be the same as for the second example above. At the outlet of the first refrigerant circuit 322, the nitrogen-rich gas fraction is supplied to a nitrogen heat recovery exchanger 311 from which it exits at a flow rate of 4,356 lbmoles per hour containing 99% vol. of nitrogen gas and 1% vol. of methane gas at 103 kPag and −45° C. To perform liquefaction and nitrogen rejection, the second cryogenic refrigerant having the same composition as in the first and second examples above is supplied from the inlet of the system 400 at 88 kPag and −183° C. This second cryogenic refrigerant exits the fifth heat exchanger 307 at 78 kPag and −161° C. to be supplied to the third heat exchanger 309 from which it exits at 78 kPag and −150° C. The second cryogenic refrigerant is supplied to the second heat exchanger 303 from which it exits at 68 kPag and −130.7° C. It then returns to the system 400 to be cooled before returning to the system 300.

Overall, as can be appreciated, the proposed concept represents a universal solution which is not site specific. For instance, a system such as the system 300 can be operated to produce LMG of substantially the same quality even if the proportions of methane and nitrogen vary, for example with nitrogen in concentration that can vary from 0 to 50% vol. The nitrogen venting outlet 316 will contain only traces of methane gas, for example no more than 1% vol. of methane gas. Nearly all the nitrogen is removed from the LMG.

The present detailed description and the appended figures are meant to be exemplary only. A skilled person will recognize that variants can be made in light of a review of the present disclosure without departing from the proposed concept.

REFERENCE NUMERALS

10 Arrangement
100 Gas supply system
101 Landfill site
102 Anaerobic digester
103 Natural gas pipeline
104 Biogas compression, control and primary treatment subsystem

105 Natural gas control device
106 Methane gas mixing vessel
200 Gas treatment system
202 High pressure compressor
203 Combined gas cooler and two-phase separator unit
204 Gas dehydrator
205 Gas precooling unit
206 Gas phase-separator vessel
207 Primary adsorption receiver
208 Secondary adsorption receiver
209 Absorption acid gas removal subsystem (high pressure)
210 Combined gas cooler and two-phase separator unit
300 LMG production and nitrogen rejection system
301 First heat exchanger
302 Sixth heat exchanger
303 Second heat exchanger
304 Fractional distillation column
305 Fourth heat exchanger
306 Expansion valve
307 Fifth heat exchanger
308 Nitrogen phase-separator vessel
309 Third heat exchanger
310 LMG storage tank
311 Nitrogen heat recovery exchanger
312 LMG reboiler control valve
313 LMG reboiler bypass control valve
314 LMG flow control valve
315 Nitrogen vent control valve
316 Venting outlet
320 Mixed methane gas feed stream circuit
322 First refrigerant circuit
324 Second refrigerant circuit
326 LMG circuit
328 Nitrogen-rich gas fraction circuit
330 Reboiler circuit
332 By-pass circuit
400 Independent cryogenic refrigeration system
401 Compressor
402 Refrigerant cooler
403 Phase-separator vessel
404 First secondary heat exchanger
405 Second secondary heat exchanger
406 Primary heat recovery exchanger
407 Control valve
408 Control valve
409 Control valve
410 Refrigerant mixer
500 LMG production integrated control system
501 LMG demand controller
502 Methane gas supply controller
503 Gas treatment system controller
504 LMG production and nitrogen rejection system controller
505 Independent cryogenic refrigeration system controller

What is claimed is:

1. A method of continuously producing a liquefied methane gas (LMG) from a pressurized mixed methane gas feed stream, the mixed methane gas feed stream containing methane and a variable concentration of nitrogen within a range that includes nitrogen being substantially absent from the mixed methane gas feed stream, the method including the simultaneous steps of:

(A) passing the mixed methane gas feed stream through a first heat exchanger and then through a second heat exchanger to condense at least a portion of the mixed methane gas feed stream, the first heat exchanger using a first cryogenic refrigerant and the second heat exchanger using a second cryogenic refrigerant;

(B) sending the mixed methane gas feed stream coming out of the second heat exchanger though a mid-level inlet of a fractional distillation column;

(C) when nitrogen is present in the mixed methane gas feed stream, separating the mixed methane gas feed stream inside the fractional distillation column into a methane-rich liquid fraction and a nitrogen-rich gas fraction;

(D) withdrawing the methane-rich liquid fraction accumulating at a bottom of the fractional distillation column through a bottom outlet, the methane-rich liquid fraction constituting the LMG;

(E) passing the LMG from the bottom outlet in step (D) through a third heat exchanger, the third heat exchanger using the second cryogenic refrigerant to further cool the LMG;

(F) when nitrogen is present in the mixed methane gas feed stream in step (C):

(i) withdrawing the nitrogen-rich gas fraction at a top of the fractional distillation column through a top outlet;

(ii) passing the nitrogen-rich gas fraction through a fourth heat exchanger and then through a fifth heat exchanger, the fourth heat exchanger using the first cryogenic refrigerant and the fifth heat exchanger using the second cryogenic refrigerant;

(iii) introducing the nitrogen-rich gas fraction coming out of the fifth heat exchanger into a nitrogen phase separator vessel where a liquid phase is separated from a gas phase;

(iv) withdrawing the liquid phase accumulating inside the nitrogen phase separator vessel and introducing the withdrawn liquid phase by gravity into the fractional distillation column as a reflux stream through an overhead inlet of the fractional distillation column, the overhead inlet being located vertically above the mid-level inlet and below the top outlet;

(v) withdrawing the gas phase from inside the nitrogen phase separator vessel and passing the withdrawn gas phase directly into an expansion valve;

(vi) using the expanded gas coming out of the expansion valve as the first cryogenic refrigerant, the first cryogenic refrigerant circulating in an open-loop first refrigerant circuit originating at an outlet of the expansion valve and then passing through, in succession, the fourth heat exchanger and the first heat exchanger; and (vii) venting the first cryogenic refrigerant, coming from the first heat exchanger, out of the first refrigerant circuit; and (G) circulating the second cryogenic refrigerant in a closed-loop second refrigerant circuit, the second refrigerant circuit extending from an independent cryogenic refrigeration system to the fifth heat exchanger, from the fifth heat exchanger to the third heat exchanger, from the third heat exchanger to the second heat exchanger, and then from the second heat exchanger back to the independent cryogenic refrigeration system.

2. The method as defined in claim 1, wherein the first cryogenic refrigerant coming out of the first refrigerant circuit contains nitrogen having a methane-gas content of less than 1% vol.

3. The method as defined in claim 1, wherein venting the first cryogenic refrigerant out of the first refrigerant circuit includes venting the first cryogenic refrigerant directly into the atmosphere.

4. The method as defined in claim 1, wherein the method includes at least one of the following features:

the LMG withdrawn from the bottom outlet in step (D) contains less than 2% vol. of nitrogen;

the mixed methane gas feed stream entering the first heat exchanger is at a pressure between 1,380 kPag and 2,070 kPag.

5. The method as defined in claim 1, wherein at least a portion of the nitrogen-rich gas fraction undergoes a phase change to a liquid phase inside the fifth heat exchanger when nitrogen is present in the mixed methane gas feed stream in step (C).

6. The method as defined in claim 5, wherein at least another portion of the nitrogen-rich gas fraction also undergoes a phase change to a liquid phase inside the fourth heat exchanger when nitrogen is present in the mixed methane gas feed stream in step (C).

7. The method as defined in claim 1, wherein the step of separating the mixed methane gas feed stream inside the fractional distillation column includes circulating a portion of the mixed methane gas feed stream from inside the fractional distillation column through a reboiler circuit located outside the fractional distillation column, the reboiler circuit passing through a sixth heat exchanger in which the reboiler circuit is in indirect heat exchange relationship with the mixed methane gas feed stream coming through a by-pass circuit, the by-pass circuit having an inlet and an outlet that are both provided downstream the first heat exchanger and upstream the second heat exchanger.

8. The method as defined in claim 1, wherein at least a portion of the mixed methane gas feed stream is biogas;

a portion of the mixed methane gas feed stream also includes gas from an alternative source of methane gas when the biogas has a methane gas content of less than a threshold value.

9. The method as defined in claim 1, wherein nitrogen is considered to be substantially absent from the mixed methane gas feed stream when a nitrogen concentration is less than 3% vol.

10. A method of continuously producing a liquefied methane gas (LMG) from a pressurized mixed methane gas feed stream, the mixed methane gas feed stream containing methane and a variable concentration of nitrogen, the method including the simultaneous steps of:

(A) passing the mixed methane gas feed stream through a first heat exchanger and then through a second heat exchanger to condense at least a portion of the mixed methane gas feed stream, the first heat exchanger using a first cryogenic refrigerant and the second heat exchanger using a second cryogenic refrigerant;

(B) sending the mixed methane gas feed stream coming out of the second heat exchanger through a mid-level inlet of a fractional distillation column to separate the mixed methane gas feed stream into a methane-rich liquid fraction and a nitrogen-rich gas fraction;

(C) withdrawing the methane-rich liquid fraction accumulating at a bottom of the fractional distillation column through a bottom outlet, the methane-rich liquid fraction constituting the LMG;

(D) passing the LMG withdrawn from the bottom outlet in step (C) through a third heat exchanger to further cool the LMG;

(E) withdrawing the nitrogen-rich gas fraction at a top of the fractional distillation column through a top outlet;

(F) passing the nitrogen-rich gas fraction through a fourth heat exchanger and then through a fifth heat exchanger, the fourth heat exchanger using the first cryogenic refrigerant and the fifth heat exchanger using the second cryogenic refrigerant, at least a portion of the nitrogen-rich gas fraction undergoing a phase change to a liquid phase inside the fifth heat exchanger;

(G) introducing the nitrogen-rich gas fraction coming out of the fifth heat exchanger into a nitrogen phase separator vessel where the liquid phase is separated from a gas phase;

(H) withdrawing the liquid phase accumulating at a bottom of the nitrogen phase separator vessel and introducing the withdrawn liquid phase by gravity into the fractional distillation column as a reflux stream through an overhead inlet located above the mid-level inlet and below the top outlet;

(I) withdrawing the gas phase from a top of the nitrogen phase separator vessel and passing the withdrawn gas phase directly into an expansion valve;

(J) using the expanded gas coming out of the expansion valve as the first cryogenic refrigerant, the first cryogenic refrigerant circulating in an open-loop first refrigerant circuit originating at an outlet of the expansion valve and then passing through, in succession, the fourth heat exchanger and the first heat exchanger;

(K) venting the first cryogenic refrigerant, coming from the first heat exchanger, out of the first refrigerant circuit; and (L) circulating the second cryogenic refrigerant in a closed-loop second refrigerant circuit, the second refrigerant circuit extending from an independent cryogenic refrigeration system to the fifth heat exchanger, from the fifth heat exchanger to the third heat exchanger, from the third heat exchanger to the second heat exchanger, and then from the second heat exchanger back to the independent cryogenic refrigeration system.

11. The method as defined in claim 10, wherein the first cryogenic refrigerant coming out of the first refrigerant circuit contains nitrogen having a methane-gas content of less than 1% vol.

12. The method as defined in claim 10, wherein venting the first cryogenic refrigerant out of the first refrigerant circuit includes venting the first cryogenic refrigerant directly into the atmosphere.

13. The method as defined in claim 10, wherein the method includes at least one of the following features:

the LMG withdrawn from the bottom outlet in step (C) contains less than 2% vol. of nitrogen;

the mixed methane gas feed stream entering the first heat exchanger is at a pressure between 1,380 kPag and 2,070 kPag.

14. The method as defined in claim 10, wherein a portion of the nitrogen-rich gas fraction also undergoes a phase change to a liquid phase inside the fourth heat exchanger.

15. The method as defined in claim 10, wherein the step of separating the mixed methane gas feed stream inside the fractional distillation column includes circulating a portion of the mixed methane gas feed stream from inside the fractional distillation column through a reboiler circuit located outside the fractional distillation column, the reboiler circuit passing through a sixth heat exchanger in which the reboiler circuit is in indirect heat exchange relationship with the mixed methane gas feed stream coming through a by-pass circuit, the by-pass circuit having an inlet and an outlet that are both provided downstream the first heat exchanger and upstream the second heat exchanger.

16. The method as defined in claim 10, wherein at least a portion of the mixed methane gas feed stream is biogas.

17. The method as defined in claim 16, wherein a portion of the mixed methane gas feed stream also includes gas from an alternative source of methane gas when the biogas has a methane gas content of less than a threshold value.

18. An arrangement for continuously producing a liquefied methane gas (LMG) from a pressurized mixed methane gas feed stream, the mixed methane gas feed stream containing methane and a variable concentration of nitrogen, the arrangement including:

a fractional distillation column having a top outlet, a bottom outlet, a mid-level inlet and an overhead inlet located above the mid-level inlet and below the top outlet;

a mixed methane gas feed stream circuit for a mixed methane gas feed stream, the mixed methane gas feed stream circuit extending, in succession, between an inlet of the mixed methane gas feed stream circuit, a first heat exchanger, a second heat exchanger, and the mid-level inlet of the fractional distillation column;

a liquid methane gas (LMG) circuit, the LMG circuit extending between the bottom outlet of the fractional distillation column, a third heat exchanger, and an outlet of the LMG circuit;

a nitrogen phase separator vessel having a mid-level inlet, a top outlet and a bottom outlet, the bottom outlet of the nitrogen phase separator vessel being in fluid communication with and positioned vertically above the overhead inlet of the fractional distillation column;

an expansion valve in direct fluid communication with the top outlet of the nitrogen phase separator vessel;

an opened-loop first refrigerant circuit for a first cryogenic refrigerant, the first refrigerant circuit extending, in succession, between an outlet of the expansion valve, a fourth heat exchanger, the first heat exchanger and a venting outlet of the first refrigerant circuit;

a closed-loop second refrigerant circuit for a second cryogenic refrigerant, the second refrigerant circuit being in fluid communication with an inlet and an outlet of an independent cryogenic refrigeration system, the second refrigerant circuit extending, in succession, between the outlet of the independent cryogenic refrigeration system, a fifth heat exchanger, the third heat exchanger, the second heat exchanger and the inlet of the independent cryogenic refrigeration system; and a nitrogen-rich gas fraction circuit extending, in succession, between the top outlet of the fractional distillation column, the fourth heat exchanger, the fifth heat exchanger and the mid-level inlet of the nitrogen phase separator vessel.

19. The arrangement as defined in claim 18, further including a sixth heat exchanger and a reboiler circuit in fluid communication with the fractional distillation column, the reboiler circuit passing through the sixth heat exchanger in which the reboiler circuit is in indirect heat exchange relationship with at least a portion of the mixed methane gas feed stream coming from a by-pass circuit, the by-pass circuit having an inlet and one outlet that are both provided, on the mixed methane gas feed stream circuit, downstream the first heat exchanger and upstream the second heat exchanger.

20. The arrangement as defined in claim 18, wherein the arrangement includes at least one of the following features:

the outlet of the LMG circuit is located in a storage tank;

the arrangement further includes a nitrogen heat recovery exchanger that is immediately upstream the venting outlet of the first refrigerant circuit.

* * * * *